United States Patent [19]

Thomsen

[11] Patent Number: 4,786,040

[45] Date of Patent: Nov. 22, 1988

[54] METHOD AND APPARATUS FOR FEEDING ENVELOPES TO A PRINTING PRESS

[76] Inventor: Elmer R. Thomsen, 1021 NE. 135th Ave., Portland, Oreg. 97230

[21] Appl. No.: 31,644

[22] Filed: Mar. 30, 1987

[51] Int. Cl.[4] ..... B65H 5/02

[52] U.S. Cl. ..... 271/3.1; 271/124; 271/212

[58] Field of Search ..... 271/3.1, 212, 121, 124, 271/125

[56] References Cited

U.S. PATENT DOCUMENTS

| | | | |
|---|---|---|---|
| 3,998,451 | 12/1976 | McInerny | 271/212 |
| 4,369,959 | 1/1983 | Hornbuckle | 271/212 X |
| 4,478,400 | 10/1984 | Commers | 271/212 X |

*Primary Examiner*—Richard A. Schacher
*Attorney, Agent, or Firm*—Olson and Olson

[57] ABSTRACT

A vertical stack of envelopes is produced adjacent the infeed end of a printing press, for removal one at a time by envelope infeed mechanism of the printing press, the stack being maintained by adding envelopes one at a time to the bottom end of the stack when the height of the stack or number of envelopes in the stack is reduced to a predetermined magnitude, the rear end of the stack being elevated to facilitate insertion of added envelopes to the bottom of the stack. The envelopes are removed one at a time by operation of the envelope infeed mechanism of the printing press. The addition of envelopes to the stack is stopped when the height of the stack or number of envelopes in the stack is increased to a predetermined magnitude.

15 Claims, 2 Drawing Sheets

METHOD AND APPARATUS FOR FEEDING ENVELOPES TO A PRINTING PRESS

BACKGROUND OF THE INVENTION

This invention relates to the feeding of envelopes to a printing press, and more particularly to a novel method and envelope feeder which, although it is independent of the printing press, delivers envelopes to the printing press at a rate determined by the rate of operation of the printing press.

Envelope feeders of the prior art are characterized by a construction which requires positive coupling to the drive mechanism of the printing press in order to synchronize the rate of delivery of envelopes to the press to the rate of movement of envelopes through the press. This requires significant structural variations in the feeder to accommodate use with various types and models of printing presses of diverse manufacture. This requirement contributes to excessive cost of manufacture of the feeders and to excessive cost of print production due to the time required to couple and uncouple the feeder and printing press.

SUMMARY OF THE INVENTION

The method and envelope feeder of this invention operates to maintain a vertical stack of envelopes at the infeed end of a printing press for acceptance by the printing press by independent operation of the infeed mechanism of the press.

It is the principal objective of this invention to provide a method and apparatus which overcome the aforementioned disadvantages and limitations of prior envelope feeders and methods.

Another objective of this invention is the provision of an envelope feeder of the class described which assures the maintenance of a vertical stack of envelopes available to the infeed mechanism of a printing press.

A further objective of this invention is to provide an envelope feeder of the class described which produces a vertical stack of envelopes by building the stack from the bottom by underlapping each succeeding envelope to the stack, thereby enabling the envelopes in the stack to be infed to a printing press sequentially from the top of the stack.

Still another objective of this invention is to provide an envelope feeder of the class described which is usable with a wide range of types and models of printing presses.

A still further object of this invention is the provision of an envelope feeder of the class described which is of simplified construction for economical manufacture, maintenance and repair and is operable with precision to make envelopes available to a printing press in accordance with the speed of operation of the press.

The foregoing and other objects and advantages of this invention will appear from the following detailed description, taken in connection with the accompanying drawings of a preferred embodiment.

DESCRIPTION OF THE PREFERRED EMBODIMENT

Figures 1, 2, 3:
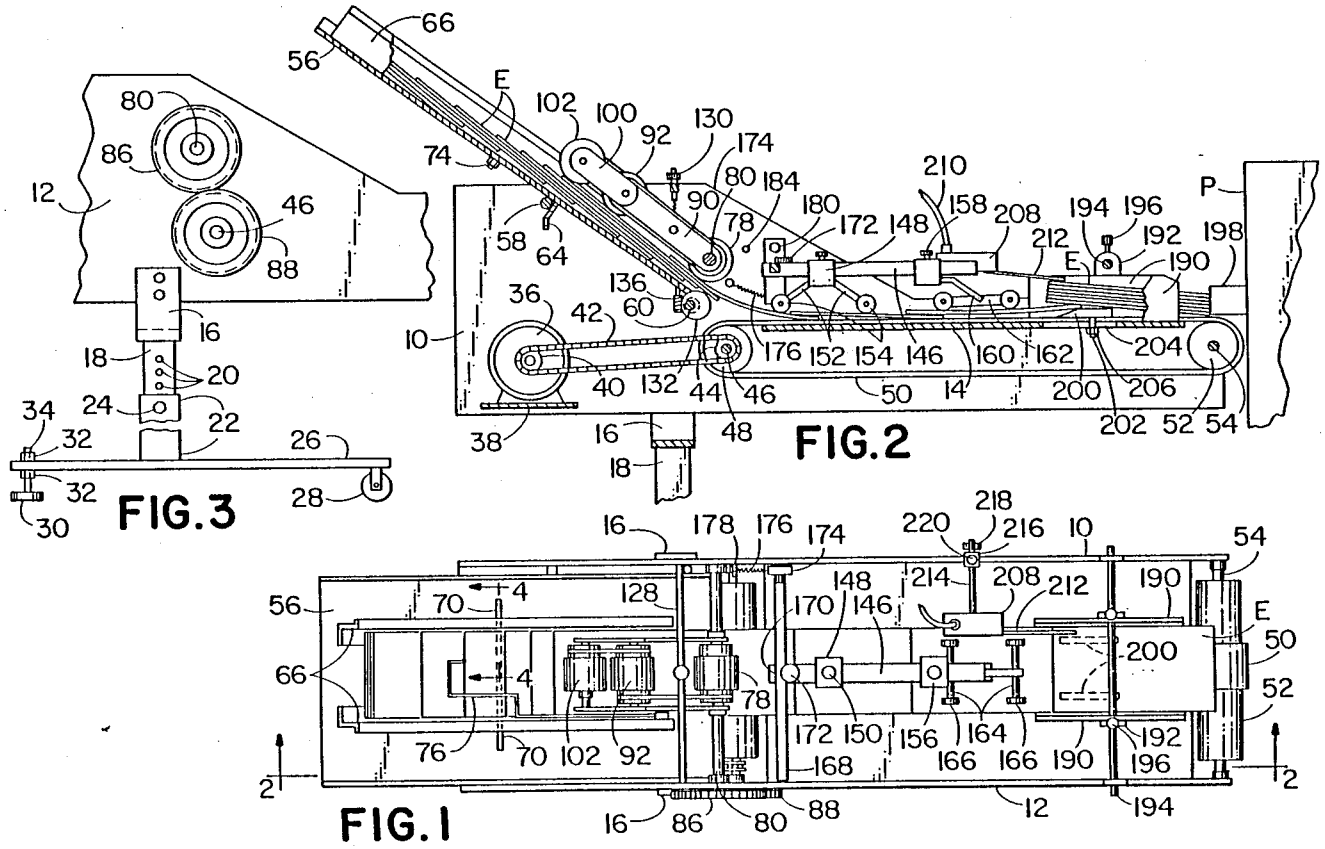
FIG. 1 is a plan view of an envelope feeder embodying the features of this invention.
FIG. 2 is a longitudinal sectional view taken on the line 2—2 in FIG. 1.
FIG. 3 is a fragmentary side elevation of the left hand portion of FIG. 1 as viewed from the bottom in FIG. 1 and showing a portable, vertically adjustable support for the envelope feeder.

The illustrated embodiment of an envelope feeder of this invention includes a frame formed of laterally spaced side walls 10 and 12 secured together by the horizontal base plate 14.

It is an important feature of this invention that the envelope feeder is completely separate from and independent of operation of a printing press with which it is to be associated. To this end, the frame is secured to a supporting yoke 16 (FIG. 3) carried at the upper end of a telescoping post 18 provided with a plurality of vertically spaced openings 20. The post 18 telescope within a cooperating hollow post 22 which is provided with a transverse opening for the reception of a connecting bolt 24 configured for removable reception through a selected one of the vertically spaced openings 20. It is by this means that the frame of the envelope feeder is adjusted vertically to conform to the elevated position of the envelope infeed mechanism of a printing press. The bottom end of the hollow post 22 is mounted on the support platform 26 which is rendered mobile by the underlying wheels 28 and rear pads 30 which are vertically adjustable by the nuts 32 on the threaded rods 34 to allow for uneven floor support.

The frame supports an electric drive motor 36 (FIG. 2) which is mounted upon a base 38 extending between the side walls 10 and 12 of the frame. The output shaft of the drive motor mounts an output sprocket 40 which is coupled through drive chain 42 to a sprocket 44 on the main power shaft 46. This shaft extends transversely between the side walls of the frame and is supported in end bearings for axial rotation.

The main power shaft mounts a support roll 48 for the rearward end of an envelope delivery conveyor belt 50 the forward end of which is supported by the front roll 52 mounted for rotation with idler shaft 54. This shaft also extends between the side walls 10 and 12 of the frame and is journaled in end bearings.

An envelope storage tray 56 is supported between the side walls of the frame adjacent the rearward end of the frame. In the preferred embodiment illustrated, the storage tray is mounted removably in the frame in a forwardly declining disposition, by means of the rearward support rod 58 and the forward stone-mounting shaft 60 described more fully hereinafter. A pair of laterally spaced arcuate hook members 62 (FIG. 7) on the forward portion of the underside of the tray engage the stone-mounting shaft 60, to secure the tray against upward and forward displacement. A stop bracket 64

(FIG. 2) on the bottom side of the storage tray is arranged to abut the forward side of the rearward support rod 58 prevent rearward displacement of the tray. The tray thus is secured in proper position relative to the conveyor belt 50.

Figure 4:
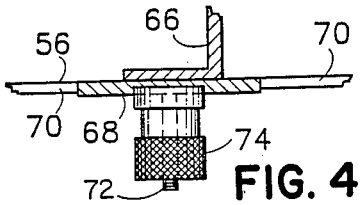
FIG. 4 is a fragmentary sectional view taken on the line 4—4 in FIG. 1.

Laterally spaced envelope guide rails 66 are secured in the storage tray for properly positioning a stack of envelopes E to be fed through the feeder. In the embodiment illustrated, the guide rails are mounted on the storage tray 56 for lateral adjustment to different spacings, whereby to accommodate a range of envelope sizes. For this purpose (FIGS. 1 and 4) a laterally elongated bar 68 extends downward from each guide rail into a laterally extending slot 70 in the tray, and a threaded stud 72 on the bar receives a nut 74 to engage the underside of the tray, to clamp the guide rails in desired position on the tray.

An envelope hold down wire 76 (FIG. 1) is mounted frictionally on one of the guide rails 66 in position to retractably overlie a stack of envelopes E on the tray to restrict their downward movement.

Figure 5:
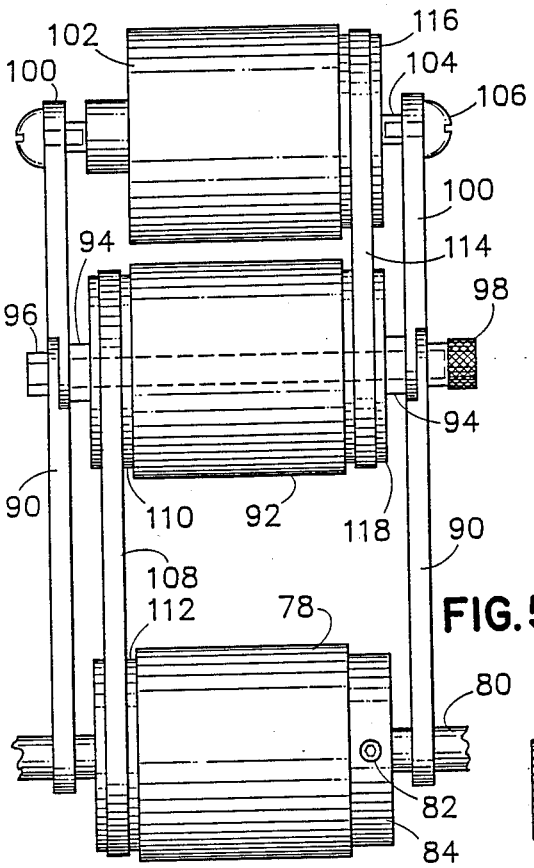
FIG. 5 is a fragmentary plan view of the envelope feed roll assembly, on an enlarged scale as compared with FIG. 1.

The stack of envelopes in the storage tray are fed one at a time to the conveyor belt 50 by means of a driven feed roll assembly. This assembly includes a front main feed roll 78 secured releasably to a drive shaft 80 by a set screw 82 (FIG. 5) extended through a lateral extension 84 on one end of the roll 78. The drive shaft 80 extends transversely of the frame and is journaled for rotation in support bearings on the frame side walls. One end of the shaft extends through an opening in the side wall 12 and mounts a gear 86 which couples with the gear 88 secured to the main shaft 46. Thus, the front feed roll 78 is coupled through the main shaft to the electric drive motor 36 for simultaneous rotation with the delivery conveyor 50.

Supported by the feed roll drive shaft 80 for pivotal movement relative thereto are a pair of laterally spaced side plates 90 on opposite sides of the front feed roll 78. These side plates extend rearwardly of the front feed roll and mount between them a middle feed roll 92 supported for rotation about a fixed hollow shaft 94 and secured releasably between the side plates by bolt 96 extended through the hollow shaft and provided with knurled nut 98 to facilitate hand turning.

A second pair of side plates 100 are joined at their forward ends pivotally to the rearward ends of the first pair of side plates 90 by the bolt 96 and nut 98. For this purpose the joined ends of the side plates are reduced in thickness and lapped, as illustrated, to maintain uniform the spacing between the pairs of side plates 90 and 100.

The side plates 100 support between them a rear fed roll 102 mounted for rotation about a shaft 104 secured between the side plates by screws 106.

The middle feed roll 92 is driven by a belt 108 which couples a sprocket 110 on the middle feed roll to a sprocket 112 on the front feed roll 78. Similarly, the rear feed roll 102 is driven by belt 114 which couples a sprocket 116 on the rear feed roll to a sprocket 118 on the middle feed roll 92.

It is to be noted that the assembly of middle feed roll 92 and rear feed roll 102 may be pivoted upward away from the storage tray to facilitate removal of the tray and also to facilitate the insertion of a stack of envelopes on the tray. Also, the rear reed roll 102 may be pivoted upward relative to the middle feed roll 92 by pivoting the rearward pair of side plates 100 about the axis of the bolt 96 and nut 98. The rear feed roll is secured in this upward position by frictionally clamping together the lapped ends of the side plates by tightening the nut 98. This elevated position of rear feed roll 102 is desirable when short envelopes are being fed to the conveyor 50 and when the stack of envelopes on the tray is thicker than usual.

Figure 6:
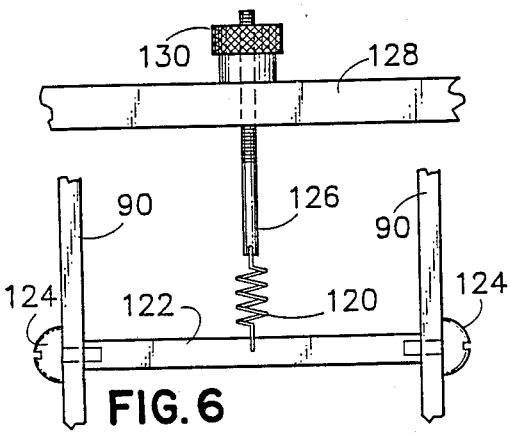
FIG. 6 is a fragmentary vertical elevation, on an enlarged scale, of a resilient support for the feed roll assembly.

The feed roll assembly also is supported resiliently by a spring 120 (FIG. 6) attached at one end to a bar 122 secured transversely between the side plates 90 by screws 124. The opposite end of the spring is attached to the lower end of a threaded rod 126 extended upward through an opening in a bar 128 secured transversely between the side walls 10 and 12 by screws. A knurled nut 130 on the upper end of the rod 126 serves to adjust the rod vertically to vary the tension of spring 120 and thus the resilient support of the feed roll assembly. It is by this means that the pressure of the feed rolls 92 and 102 on the tray 56 may be relieved when no more envelopes E are in the tray. This avoids undesirable wear of the feed rolls.

Associated with the front feed roll 78 is spacer means by which to adjust the spacing under the front feed roll through which to control the number of envelopes that may be moved forwardly at the same time. In the embodiment illustrated, the spacer means is provided in the form of a pinch stone 132 secured to the mounting shaft 62 previously mentioned. The shaft is journaled in end bearings between the side walls 10 and 12 of the frame. A worm wheel 134 on the shaft 62 meshes with a worm 136 secured to the lower end of a shaft 138 which is mounted for rotation in a support block 140. A control knob 142 at the upper end of the shaft 138 facilitates rotation of the latter.

Figure 7:
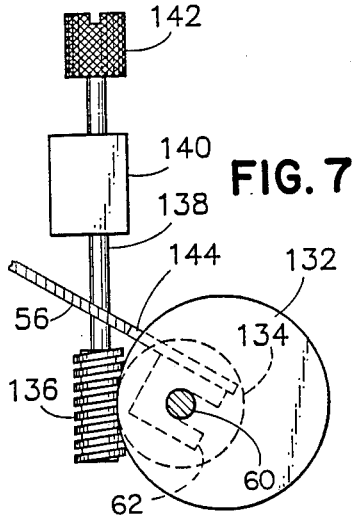
FIG. 7 is a fragmentary side elevation of an adjustable envelope feed control associated with the driven feed roll assembly component of the envelope feeder, parts being broken away to disclose structural details.

It is to be noted particularly in FIG. 7 of the drawings that the pinch stone 132 is mounted eccentrically on the shaft 62, so that rotation of the shaft operates to move the surface of the pinch stone toward and away from the front feed roll 78 and thereby vary the spacing therebetween. An access slot 144 in the storage tray 56 registers with the pinch stone to accommodate the foregoing adjustment of the stone relative to the front feed roll.

In the preferred mode of operation of the envelope feeder, the pinch stone 132 is adjusted to restrict the spacing between it and the front feed roll 78 so as to allow only two envelopes E to move between them at the same time. Thus, upon energization of the drive motor 36 and consequent rotation of the delivery conveyor 50 and the feed roll assembly, the uppermost envelope in the storage tray is fed forward under the feed rolls and onto the delivery conveyor. The next underlying envelope also is moved forward with the overlying envelope, but when it engages the pinch stone the latter provides sufficient friction to resist slightly the forward movement of the engaging envelope, even though that envelope is being driven forwardly by the middle feed roll 92. It is by this means that the uppermost pair of envelopes are spaced apart longitudinally with the rearward end portion of the upper envelope overlapping the forward portion of the next succeeding envelope.

When the uppermost envelope passes forwardly of the front feed roll 78, the next succeeding envelope then becomes the uppermost envelope, and the third envelope in the stack is driven forwardly by the rear feed roll 102, becoming paired with the second envelope to pass through the space between the pinch stone 132 and the front feed roll 78. The foregoing sequence of operation is repeated to produce a continuously forwardly moving train of envelopes, with the trailing end of each preceding envelope overlapping the leading end of the next succeeding envelope.

The train of lapped envelopes are moved forwardly by operation of the delivery conveyor 50 the working stretch of which overlies the base plate 14 of the frame (FIG. 2). The train of envelopes on the delivery conveyor are held down against the conveyor by a hold down assembly. This assembly includes an elongated support bar 146 which is positioned above the delivery conveyor and extends longitudinally parallel thereto. The support bar mounts a rear carriage 148 which is adjustable along the bar and is secured in desired position by a set screw 150. The rear carriage pivotally mounts a pair of hold down arms 152 the lower ends of which support hold down rolls 154 arranged to bear upon the upper surfaces of envelopes moving forwardly on the delivery conveyor.

The support bar 146 also mounts a front carriage 156 which is adjustable along the bar and secured in desired position by set screw 158. The front carriage mounts an arm 160 which declines angularly forward therefrom and mounts pivotally at its lower end a roll-mounting bar 162. Mounted at the forward and rearward ends of the mounting bar 162 are a pair of transverse axles 164 each of which rotatably mounts a pair of hold down rolls 166. Like rolls 154, the rolls 166 also are arranged to bear downwardly upon the upper surfaces of envelopes moving forward on the delivery conveyor.

The above described hold down assembly is provided with resilient downward pressure for insuring continuous pressure contact with envelopes moving forward on the delivery conveyor. In the embodiment illustrated, this is provided by a transverse pressure bar 168 journaled for rotation in bearings mounted on the side walls 10 and 12 of the frame. The square cross section of the pressure bar is received in a notch 170 in the rearward end of the support bar 146 and is retained in the notch by means of the overlying removable clamp screw 172. A lever arm 174 is secured intermediate its end to the pressure bar 168, and its lower end secures one end of a spring 176. The opposite end of the spring is secured to the side wall 10 by means of an anchor screw 178.

Figure 8:
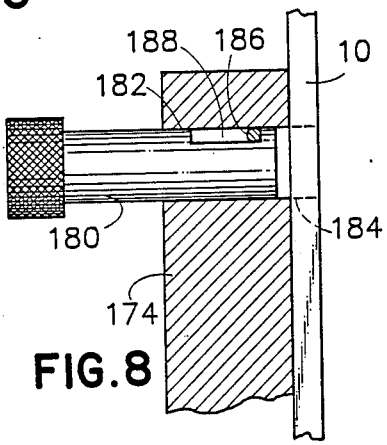
FIG. 8 is a fragmentary vertical elevation, on an enlarged scale, of means for securing the hold down assembly in retracted position.

The hold down assembly is adjustable between the operative position illustrated and an inoperative position elevated above the conveyor 50. This is afforded by a latch pin 180 (FIG. 8) which is mounted for movement in a bore 182 in the lever arm 174 between a latching position extending into an opening 184 in the side wall 10 when the lever arm and hold down assembly are rotated counterclockwise about the pressure bar 168, and an unlatching position retracted from the opening 184. A stop pin 186 in the lever arm 174 extends across the bore 182 and through a notch 188 in the latch pin 180 to limit movement of the latter between said latching and unlatching positions.

The front end of the frame base 14 constitutes an envelope delivery end and is adapted to be positioned adjacent the infeed of a printing press P. This envelope delivery end of the frame forms an envelope stacking station which is defined by a pair of laterally spaced stack guides 190. These guides are mounted upon hangers 192 which are supported on a transverse rod 194 extending between the side walls 10 and 12 of the frame. Set screws 196 in the top ends of the hangers releasably engage the support rod 194 to secure the guides 190 in desired lateral spacing, to accommodate between them a stack of envelopes E of desired size.

As the envelopes are delivered forwardly to the stacking station, the forward ends of the envelopes are brought into abutment with a stop 198. Although this stop is illustrated in the drawings as being supported by the printing press, it will be understood that the stop may alternatively be mounted on the frame of the envelope feeder.

It is to be noted that as the envelopes are delivered forwardly to the stacking station between the guides 190, they move forwardly over a pair of laterally spaced wedge shaped elevating members 200 positioned adjacent the rearward end of the stacking station on opposite sides of the delivery conveyor 44. In the preferred embodiment, these wedge shaped members are each provided with a threaded stud 202 which extends downwardly through a longitudinally elongated slot 204 in the base plate 14 for adjustment along the slot. A nut 206 on the threaded stud under the base plate serves to releasably secure the wedge 200 in adjusted position. A plurality of pairs of slots spaced apart laterally on opposite sides of the conveyor 50 at different spacings accommodate lateral adjustment of the pair of wedges for envelopes of various widths.

Alternatively, the wedge shaped members may be formed from or include therein a piece of permanent magnet. Thus, by making the base plate 14 of the frame of magnetically susceptible material, such as steel, the wedge members may be secured to the base plate magnetically in any of a variety of positions to accommodate envelopes of different sizes.

The wedge members are positioned on the base plate so that when the envelopes in the stacking station are in abutment with the stop 198, the trailing and portion of the bottommost envelope projects rearwardly of the wedge members 200 and a spaced distance above the base plate 14. This elevated position of the trailing end of the bottommost envelope in the stacking station allows the next succeeding envelope to underlap the bottommost envelope in the stack. The stack of envelopes thus is built up from the bottom.

This elevated position of the rearward portion of the bottommost envelope in the stack also insures that the next succeeding envelope will properly underlap the bottommost envelope in the stack, even though there may have been an interruption in the progression of envelopes from the storage tray. That is to say, if all of the envelopes in the train of envelopes are properly overlapped as illustrated in the drawings, then each succeeding envelope will automatically enter the stacking station under the next preceding envelope. However, if an interruption in the train of envelopes occurs so that there is a gap between a leading envelope and the next trailing envelope, then the trailing envelope might jam against the leading envelope unless the trailing end of the leading envelope is elevated by the wedge members 200, to provide a space thereunder for entrance of the next succeeding envelope. The wedge members provide this spacing to insure that the envelopes are delivered to the stacking station in properly underlapped condition.

It is another important feature of this invention that a supply of envelopes be made available to the envelope infeed mechanism of a printing press P at all times even though the envelope feeder is not synchronized to the operation of the printing press, in the manner required heretofore. This is achieved in the present invention by maintaining in the stacking station a plurality of vertically stacked envelopes sufficient to supply the operational speed of the printing press. This is achieved by insuring that the delivery of envelopes from the storage tray to the stacking station exceeds the rate of processing of the envelopes through the printing press.

In the embodiment illustrated, an electric stacker switch 208 is mounted on the frame adjacent the stacking station. An electrical conductor cable 210 connects the switch in the electric circuit of the electric drive motor 36 to control the operation of the latter. The switch is provided with an elongated actuator feeler arm 212 which overlies the stacking station in position to intercept and thus be contacted by the uppermost envelope in a stack of envelopes in the stacking station. The switch is carried by an elongated support rod 214 which extends laterally across the top of the frame wall 10. A mounting block 216 is supported on the upper edge of the frame wall 10 for adjustment along the latter. A set screw 218 in the mounting block is arranged for releasable engagement with the frame side wall 10 to secure the mounting block in desired position of adjustment. A second set screw 220 in the mounting block is arranged to releasably engage the support rod 214 to secure the latter in desired position of lateral adjustment relative to the mounting block and also rotational adjustment relative to the mounting block. It is by this means that the horizontal and vertical positions of the switch feeler arm 212 may be adjusted to 50 and feed rolls thus are once again returned to operation to resume delivery of envelopes from the storage tray to the stacking station.

Since the delivery of envelopes from the storage tray to the stacking station exceeds the rate at which the envelopes are removed from the stacking station to the printing press, the foregoing sequence of starting and stopping the drive motor continues intermittently, always insuring an adequate supply of envelopes at the stacking station to meet the requirements of the printing press.

It will be apparent to those skilled in the art that various changes may be made in the size, shape, type, number and arrangement of parts described hereinbefore without departing from the spirit of this invention and the scope of the appended claims.

Having thus described my invention and the manner in which it may be used, I claim:

1. Apparatus for feeding envelopes to a printing press having envelope infeed mechanism operable to delivery envelopes one at a time to the press, the apparatus comprising:

(a) a frame having an envelope delivery end adapted to be positioned adjacent the infeed of a printing press, (b) an envelope storage tray on the frame, (c) an envelope delivery conveyor on the frame operable to move envelopes toward the envelope delivery end of the frame, (d) an electric drive motor on the frame engaging the delivery end of the frame, (e) an envelope feed roll on the frame coupled to the drive motor for operation concurrently with the delivery conveyor for feeding envelopes from the storage tray to the delivery conveyor, (f) spacer means on the frame adjustable toward and away form the feed roll for adjusting the space therebetween for limiting the number of envelopes movable through said space at the same time to two envelopes, the spacer means engaging the underlapping envelope and retarding its forward movement relative to the overlapping preceding envelope, whereby to feed envelopes forwardly to the delivery conveyor in a succession of lapped envelopes with each succeeding envelope underlapping the next preceding envelope, (g) an envelope stacking station on the frame at the envelope delivery end thereof for receiving said lapping envelopes one at a time from the delivery conveyor and forming a vertical stack of a plurality of said envelopes, and (h) elevating means at the stacking station arranged to raise the rear end of the bottom envelope of the stack for receiving the next succeeding underlapping envelope under said bottom envelope, whereby to form a vertical stack of envelopes from the bottom and allowing the envelopes to be delivered to the printing press one at a time from the top of the stack.

2. The apparatus of claim 1 including a mobile support engaging the frame for supporting the apparatus for movement toward and away from a printing press.

3. The apparatus of claim 2 wherein the mobile support is adjustable vertically for adjusting the envelope delivery end of the frame vertically relative to the envelope infeed mechanism of a printing press.

4. The apparatus of claim 1 including an electric switch in the electric circuit of the drive motor, the switch being operable when the envelope stack increases in height to a predetermined magnitude to open the electric circuit of the motor, and when the envelope stack decreases in height to a predetermined magnitude to close the electric circuit of the motor.

5. The apparatus of claim 4 wherein the electric switch is adjustable toward and away from the stacking station for accommodating the feeding of envelopes of different sizes.

6. The apparatus of claim 4 wherein the electric switch includes stack height sensing means and the electric switch is adjustable for varying the position of the stack height sensing means for adjusting the operation of the electric switch to various heights of envelope stacks.

7. The apparatus of claim 1 wherein the storage tray is mounted removably on the frame.

8. The apparatus of claim 1 including a second feed roll rearwardly of the first named feed roll and coupled to the drive motor for operation concurrently with the first named feed roll, the second feed roll being arranged to engage the envelope in the storage tray next underlapping the preceding envelope being engaged by the first named feed roll.

9. The apparatus of claim 8 including a third feed roll rearwardly of the second feed roll and coupled to the drive motor for operation concurrently with the second feed roll, the third feed roll being arranged to engage the envelope in the storage tray next underlying the preceding envelope being engaged by the second feed roll.

10. The apparatus of claim 9 wherein the second and third feed rolls are supported for pivotal adjustment about the rotational axis of the first named feed roll.

11. The apparatus of claim 9 wherein the third feed roll is supported for pivotal adjustment about the rotational axis of the second feed roll.

12. The apparatus of claim 1 including envelope hold down means mounted on the frame above the delivery conveyor for movement toward and away from the conveyor.

13. The apparatus of claim 12 including pivot means mounting the envelope hold down means on the frame for movement between a lowered, operative position for bearing against envelopes on the delivery conveyor and a raised, inoperative position, and latch means releasably interengaging the hold down means and frame for securing the hold down means releasably in said inoperative position.

14. The apparatus of claim 12 including resilient means interengaging the hold down means and frame for urging the hold down means resiliently toward the delivery conveyor.

15. The apparatus of claim 1 wherein the elevating means is at least one wedge member mounted on the frame at the stacking station.

* * * * *

UNITED STATES PATENT AND TRADEMARK OFFICE

CERTIFICATE OF CORRECTION

PATENT NO. : 4,786,040

DATED : 22 November 1988

INVENTOR(S) : Elmer R. Thomsen

It is certified that error appears in the above-identified patent and that said Letters Patent is hereby corrected as shown below:

Column 2, line 31, "telescope" should read -- telescopes --.
Column 3, line 51, "fed" should read --feed--.
Column 7, line 49, "delivery" should read --deliver--.
Column 7, line 66, "form" should read --from--.

Signed and Sealed this

Twenty-second Day of August, 1989

*Attest:*

DONALD J. QUIGG

*Attesting Officer*

*Commissioner of Patents and Trademarks*